United States Patent [19]

Gertsch

[11] Patent Number: 4,533,156

[45] Date of Patent: Aug. 6, 1985

[54] TOE MECHANISM FOR A SAFETY SKI BINDING

[75] Inventor: Ulrich Gertsch, Interlaken, Switzerland

[73] Assignee: TMC Corporation, Baar, Switzerland

[21] Appl. No.: 333,530

[22] Filed: Dec. 22, 1981

[30] Foreign Application Priority Data

Dec. 30, 1980 [CH] Switzerland ..... 9635/80
Oct. 13, 1981 [CH] Switzerland ..... 6522/81

[51] Int. Cl.[3] ..... A63C 9/085

[52] U.S. Cl. ..... 280/629; 280/618; 280/636

[58] Field of Search ..... 280/614, 615, 633, 618, 280/617, 629, 620, 635, 630, 636

[56] References Cited

U.S. PATENT DOCUMENTS

| | | | |
|---|---|---|---|
| 3,667,770 | 6/1972 | Lawrence | 280/11.35 T |
| 3,951,424 | 4/1976 | Napflin | 280/614 |
| 3,955,825 | 5/1976 | Kubelka et al. | 280/618 |
| 3,966,218 | 6/1976 | Beyl | 280/633 |
| 3,985,371 | 10/1976 | Pyzel | 280/614 |
| 4,082,312 | 4/1978 | Johnson | 280/615 |
| 4,102,063 | 7/1978 | Ihlen | 280/615 |
| 4,125,274 | 11/1978 | Kubelka et al. | 280/618 |
| 4,154,008 | 5/1979 | Jacobs | 280/615 |
| 4,176,856 | 12/1979 | Glaser | 280/615 |
| 4,188,045 | 2/1980 | Marker | 280/614 |
| 4,314,714 | 2/1982 | Gertsch | 280/618 |

FOREIGN PATENT DOCUMENTS

| | | | |
|---|---|---|---|
| 245448 | of 1966 | Austria | 280/618 |
| 289617 | 9/1970 | Austria | 280/630 |
| 296111 | 5/1971 | Austria | 280/631 |
| 1188488 | 3/1965 | Fed. Rep. of Germany | 280/620 |
| 1229429 | 11/1966 | Fed. Rep. of Germany | 280/635 |
| 2163892 | 6/1973 | Fed. Rep. of Germany | 280/630 |
| 2838458 | of 1979 | Fed. Rep. of Germany | 280/618 |
| 2827717 | of 1979 | Fed. Rep. of Germany | 280/630 |
| 2825876 | of 1980 | Fed. Rep. of Germany | 280/618 |

*Primary Examiner*—David M. Mitchell
*Attorney, Agent, or Firm*—Flynn, Thiel, Boutell & Tanis

[57] ABSTRACT

The invention relates to a safety ski binding toe mechanism comprising a skid plate underlying the forward end of the ski boot sole. According to the invention, the skid plate, or the pivotable and longitudinally shiftable sole retainer, respectively, is provided with keying means preventing the skid plate from twisting relative to the ski boot sole at least within the elastic yield limits of the toe mechanism. The keying means may comprise a pair of guide jaws receiving the ski boot sole therebetween, or may be constituted by stop portions or projections on the upper surface of the skid plate cooperating with complementary counter stops or engagement means of the ski boot sole.

18 Claims, 22 Drawing Figures

FIG. 14
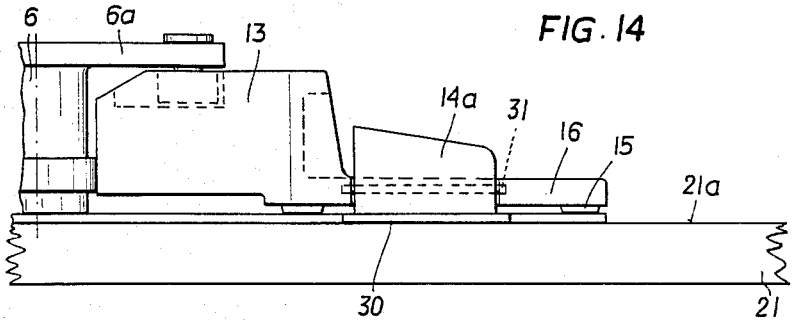
FIG. 15a
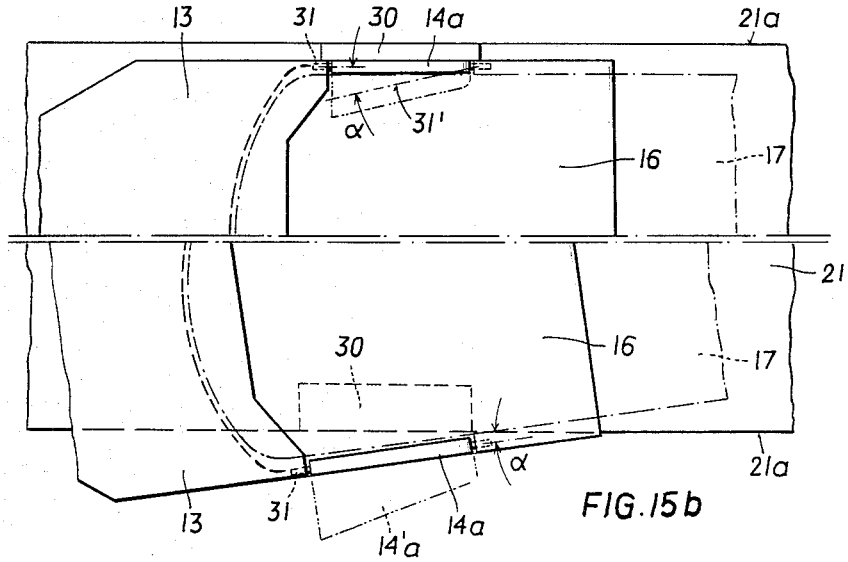
FIG. 15b
FIG. 16
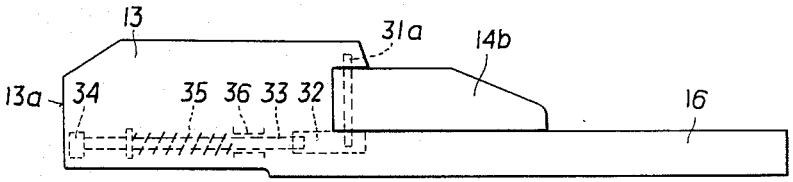
FIG. 17
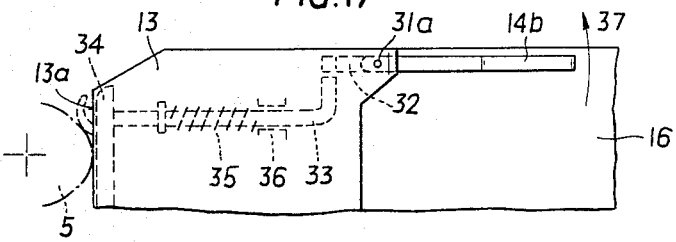

TOE MECHANISM FOR A SAFETY SKI BINDING

FIELD OF THE INVENTION

This invention relates to a toe mechanism of.

BACKGROUND OF THE INVENTION

A skid plate toe mechanism offers the advantage that a conventionally employed release plate pivotably and optionally longitudinally shiftably supported in the heel area can be omitted. This is because the ski boot resting on the skid plate provides for the requisite connection between the sole retainer and the effective turning point of the boot during torsional release or movement within the elastic yield limits.

In a toe mechanism known from U.S. Pat. No. 3,667,770, the sole retainer is connected to the skid plate through a positive coupling arrangement. The skid plate has a thrust surface extending substantially transversely of the longitudinal axis of the ski and abutting an also transversely extending rectilinear thrust surface of a slide member guided for longitudinal travel against a spring bias. Together with the skid plate the sole retainer is able to perform a lateral pivot movement as well as a longitudinally sliding movement of a limited extent, the longitudinal movement serving only to compensate for movements of the ski boot during skiing, without contributing to the release operation. In the case of pivotal movement of the sole retainer and the skid plate together with the ski boot, there occurs a twisting movement of the skid plate relative to the ski boot sole due to the construction of the mechanism. In this case there is then no connection between the sole retainer and the underlying turning point. On realignment of the ski boot within the elastic yield limits it is not positively ensured that the sole retainer and the skid plate are properly returned to the starting position, there is rather the danger that the skid plate stops in an inclined position so as to cause a faulty release operation to occur.

From Austrian Pat. No. 296,111 there is known a safety ski binding toe mechanism wherein a sole retainer is mounted in a double joint for pivotal movement in the lateral and forward directions, and is effective to press the ski boot sole downwards onto the skid plate. The ski boot sole is thus practically clamped between the sole retainer and the skid plate. This does not ensure, however, that relative torsional movements between the ski boot sole and the skid plate are reliably prevented. This clamping of the sole is also disadvantageous with respect to an unhampered release of the ski boot.

It is an object of the present invention to improve a toe mechanism of the type specified in the introduction in such a manner that the skid plate is prevented from turning relative to the ski boot sole during pivotal movements of the ski boot at least within the elastic yield limits, while retaining the advantage of the omitted release plate.

SUMMARY OF THE INVENTION

According to the invention this object is attained by providing between the ski boot sole and either or both of the sole retainer and skid plate a keying arrangement adapted to prevent rotation of the ski boot sole relative to the skid plate during lateral movement thereof, at least within the elastic yield limits of the toe mechanism.

As the keying means prevents the skid plate from turning relative to the ski boot sole, the skid plate will always be reliably returned to its original position, at least within the elastic yield limits of the toe mechanism. The toe mechanism provided with the skid plate operates as reliably as a toe mechanism with a release plate.

Although there is a ski binding known from Austrian Pat. No. 245,448, wherein a pivot plate provided with keying means is rotatably mounted on a release plate mounted for lateral and longitudinal movement about a vertical axis located at the heel portion, the release plate in this instance is necessary for the function of the binding.

Another safety ski binding is known from German Offenlegungsschrift No. 28 25 876, wherein the sole retainer is integrated with a rigid release plate provided with keying means cooperating with the ski boot for controlling the release operation. The release plate is indispensable for the function of the binding, however, and cooperates with the toe release mechanism.

An advantageous embodiment of the invention involves the sole retainer having lateral guide jaws form a reliable triangular support to ensure that the skid plate can pivot only together with the ski boot toe portion.

An alternative advantageous embodiment includes stop members located within the contours of the ski boot sole, so there are no outwardly projecting danger points.

A further advantageous embodiment uses the customary forward bias exerted by the heel mechanism for coupling the ski boot sole to the skid plate through the keying means.

In another advantageous embodiment of the invention, the active portions of the keying means are provided only at the lateral sides of the ski boot sole, and they are not subjected to wear during walking with the ski boot, and do not impede walking.

A further important aspect of the invention is of importance to the user of the ski boots, as it enables him to use the ski boots in connection with conventional safety ski bindings.

The release operation of the toe mechanism according to the invention may further be favourably influenced by features provide that which the active portions of the keying means, which are effective to prevent the ski boot from twisting relative to the skid plate within the elastic yield limits, become ineffective after the elastic yield limit has been exceeded, so as not to interfere with the lateral movement of the ski boot toe portion.

From the structural viewpoint, the last named requirement is met in a particularly simple and reliable manner when, as soon as the elastic yield limit is reached, the portions of the keying means located on the sole retainer and/or on the skid plate are released.

In this context it is advantageous to select a modified embodiment in which the skid plate as well as the sole retainer offer sufficient space for the pivotal mounting of the portions of the keying means, so that there will be no projections interfering with the release of the ski boot, while the pivotal mountings are outwardly shielded.

Of further advantage in this context is an embodiment in which the pressure of the ski boot during lateral movement thereof is directed substantially perpendicular to the pivot axis in question.

An alternative important aspect of the invention is that the angular alignment of the pivot axes takes into account that the lateral turning of the skid plate results in the active portions of the keying means coming into angular alignment with respect to the longitudinal ski edges, with the angularly aligned pivot axes ensuring that the active portions of the keying means are quickly tilted out of the way perpendicularly to the lateral edges of the ski.

As an alternative, there is an embodiment wherein the active portions of the keying means are tilted not laterally, but forwardly, so as to facilitate release of the boot.

The active portions of the keying means should reliably yield only after the elastic yield limit has been exceeded.

The quick release or yielding, at least of that active portion of the keying means located adjacent the side towards which lateral movement occurs, may be achieved in a particularly simple and expedient manner by an embodiment in which the yielding or release operation may be controlled by the lateral edges of the ski itself or by fittings located thereat. On a return of the toe mechanism to the skiing position automatically brought about by the release mechanism, the previously released active portion of the keying means will then automatically reset to its active position. The pivot mounting of each releasable portion of the keying means may alternatively or additionally be provided with a weak return spring for resetting the previously released portion to its operative position as soon as the ski boot has left the safety ski binding.

BRIEF DESCRIPTION OF THE DRAWINGS

Embodiments of the subject matter of the invention shall now be described with reference to the accompanying drawings, wherein:

FIG. 14 shows a side view of a sixth embodiment of a toe mechanism, FIG. 15*a* shows one half of a top plan view of the toe mechanism of FIG. 14, FIG. 15*b* shows a top plan view of the other half of the toe mechanism of FIG. 14 in a position at the elastic yield limit, FIG. 16 shows a side view of a seventh embodiment of the toe mechanism.

FIG. 17 shows a top plan view of one half of the toe mechanism of FIG. 16.

DETAILED DESCRIPTION

Figure 2:
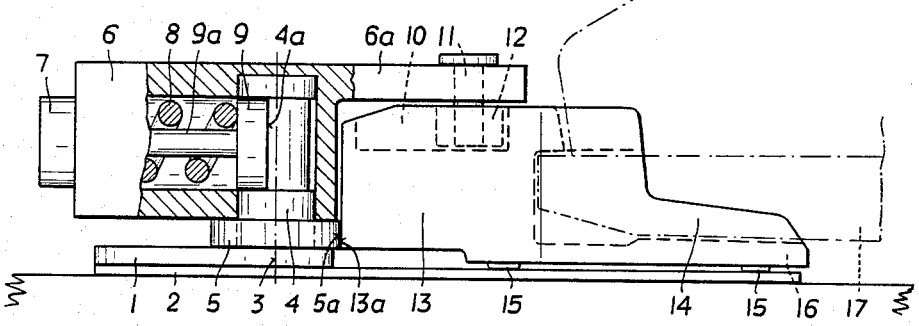
FIG. 2 shows a partially sectioned side view of the toe mechanism of FIG. 1, FIGS. 3 to 5 are top plan views which show the toe mechanism of FIG. 1 in various positions, namely in the skiing position (FIG. 3), in the position at the elastic yield limit (FIG. 4), and in the release position (FIG. 5)
Figure 1:
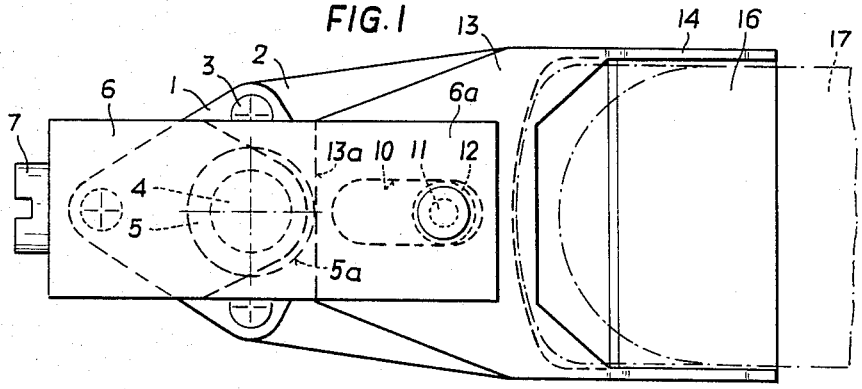
FIG. 1 shows a top plan view of a first embodiment of a toe mechanism.

Affixed to the upper surface of a ski by means of a base plate 1, 2 and screws 3 is a vertically extending cylindrical bolt 4 provided with an annular flange or a relatively rotatable annular disk 5 adjacent its lower end. For a determined portion of its height, bolt 4 is formed with a thrust surface 4*a* extending transversely of the longitudinal direction of the ski. A housing 6 of a release mechanism is pivotably supported on bolt 4 and contains a slidable plunger 9 biased into engagement with thrust surface 4*a* by a spring 8. The tension of spring 8 is selectively adjustable by an adjustment screw 7. Plunger 9 has a plunger rod 9*a* extending through spring 8. The end of housing 6 facing away from adjustment screw 7 is formed with an upper extension 6*a* to which a sole or toe holder 13 is pivotally connected by a bolt 11 or pin 11 extending perpendicular to the ski's upper surface. Sole retainer 13 is formed with a longitudinally extending slot or recess 10 slidingly receiving a guide roller 12 on lower end of bolt 11. At its end facing towards pivot bolt 4, sole retainer 13 is formed with a thrust surface 13*a* extending substantially transversely of the longitudinal direction of the ski and adapted to contact the outer peripheral surface 5*a* of disk 5. Inclined flanks extend rearward from both ends of thrust surface 13*a*. Sole retainer 13 is formed with clampdown portion adapted to overlie a sole 17 of a ski boot inserted into the safety ski binding for preventing it from being lifted upwardly. In the embodiment shown, sole retainer 13 is further formed with a skid plate 16 extending underneath the forward end of sole 17 and having a pair of guide members or guide jaws 14 extending vertically upwardly from its upper surface on opposite sides of sole 17. Sole retainer 13 as well as the rearward end of skid plate 16 are movably supported on the upper ski surface by low-friction pads 15.

Figure 3:
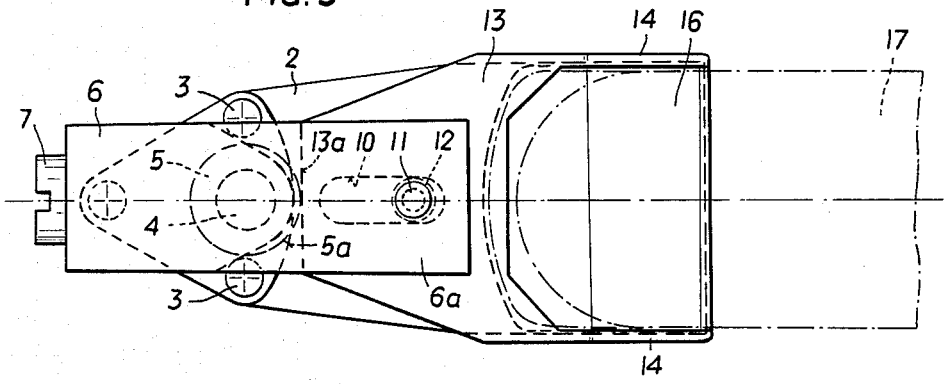
Figure 4:
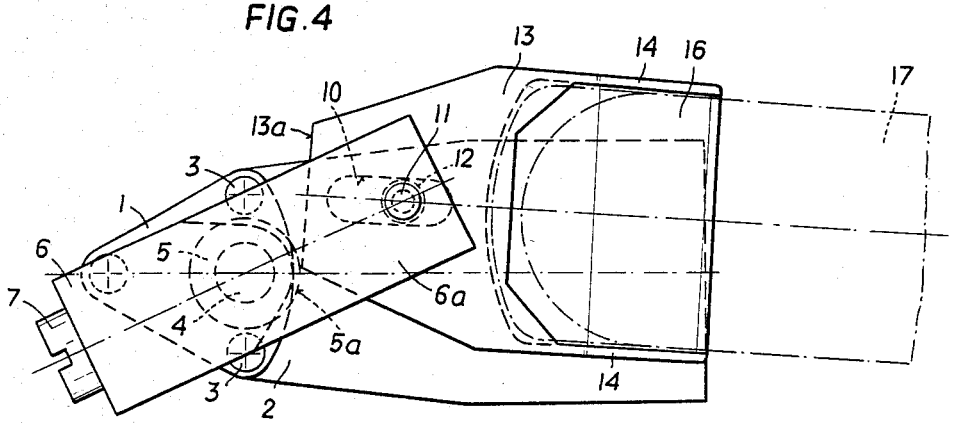
Figure 5:
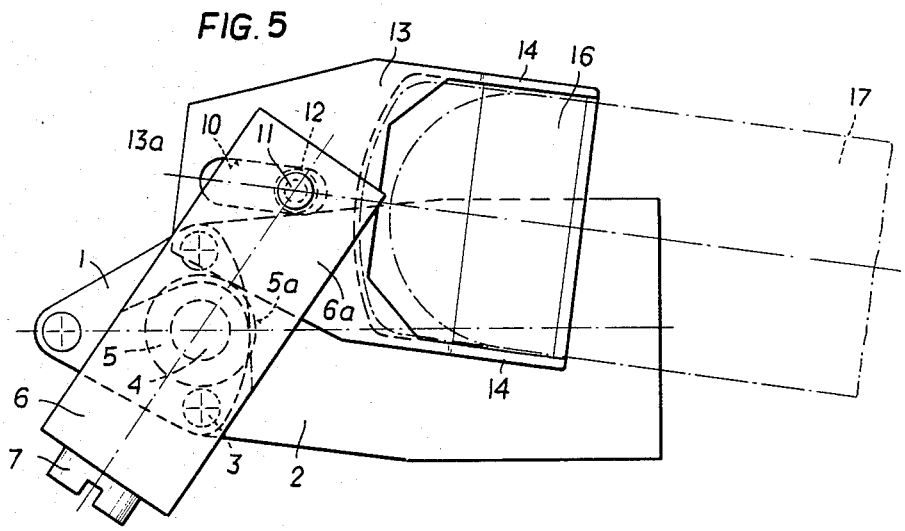

FIGS. 3 to 5 show the displacement of the various parts of the toe mechanism during a torsional movement of the ski boot sole 17 about an axis extending vertically to the ski's upper surface in the region of the heel of the sole, such as occurs during or prior to a torsion fall. In FIG. 3, the ski boot is still in the skiing position. The forward thrust usually exerted by the heel mechanism biases thrust surface 13*a* of sole retainer 13 into engagement with disk 5, so that the forces acting in the longitudinal direction of the ski are transmitted to the base plate at this point. Pin 11 with its roller 12 is disposed within the longitudinal extend of guide slot 10. Spring 8 acting through plunger 9 holds the toe mechanism centered in this position.

In the case of a lateral twisting movement occurring as shown in FIG. 4, lateral guide jaws 14 cooperate with the clampdown portion of sole retainer 13 to ensure that skid plate 16 and sole retainer 13 perform a lateral movement in unison with the ski boot. During this movement, thrust surface 13*a* rolls or slides on disk 5, with the forces acting in the longitudinal direction continuing to be transmitted to base plate 2 through disk 5. The toe mechanism is designed to have predetermined elastic yield limits within which a lateral twisting movement of the ski boot is possible without release operation. In the embodiment shown, the elastic yield limits are determined by the length of thrust surface 13*a*. In FIG. 4, the elastic yield limit is attained as the end of thrust surface 13*a* is just contacting disk 5. If at this point the torsional force exerted by the ski boot is discontinued or reduced, spring 8 acts to return the sole retainer 13 together with ski boot 17 to the position of FIG. 3, with no relative rotation occurring between skid plate 16 and ski boot sole 17. The engagement of roller 12 in slot 10 permits relative longitudinal movement between sole retainer 13 and the release mechanism to occur during this phase.

If, on the other hand, the torsional force persists, the end of thrust surface 13*a* moves beyond the longitudinal center line of the ski, and thus beyond the center of disk 5, whereupon the inclined flux extending rearward from thrust surface 13*a* opposite to the twisting direction comes into engagement with disk 5, allowing housing 6 of the release mechanism to be further rotated during further forward movement of sole retainer 13, until the ski boot is released. During this movement, guide roller 12 may travel along slot 10 into engagement with the end thereof.

As soon as the ski boot has left the toe mechanism, spring 8 acts to return the toe mechanism to its original position.

Figure 7:
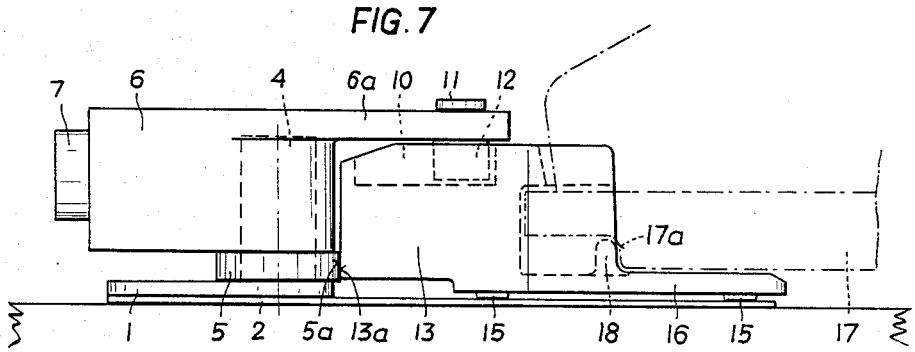
FIG. 7 shows a side view of the toe mechanism of FIG. 6.
Figure 6:
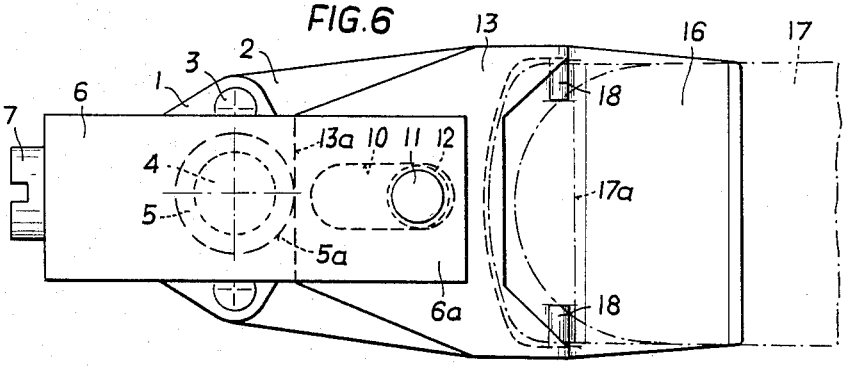
FIG. 6 shows a top plan view of a second embodiment of the toe mechanism.

The second embodiment of the toe mechanism shown in FIGS. 6 and 7 differs from the one shown in FIGS. 1 to 5 in that the lateral guide jaws on skid plate 16 are replaced by a pair of stop projections 18 aligned substantially transversely of the ski's longitudinal direction on the upper surface of skid plate 16. For cooperation with stop projections 18, the underside of the toe portion of ski boot sole 17 is formed with a recess 17*a* extending up to the toe end of sole 17. On insertion of the ski boot into the toe mechanism, or the sole retainer 13, respectively, recess 17*a* receives one of said stop projections 18 adjacent each lateral side. In cooperation with the forward thrust exerted by the (not shown) heel mechanism, the engagement of stop projections 18 in recess 17*a* results in two fixed support points operatively connecting ski boot sole 17 to skid plate 16 in such a manner that skid plate 16 is again constrained to move in unison with sole 17 in relation to the pivot axis at the heel portion of the sole. During lateral twisting movements of the ski boot sole within the elastic yield limits determined by the length of thrust surface 13*a*, there will thus be no rotary movement of skid plate 16 relative to sole 17.

Figure 9:
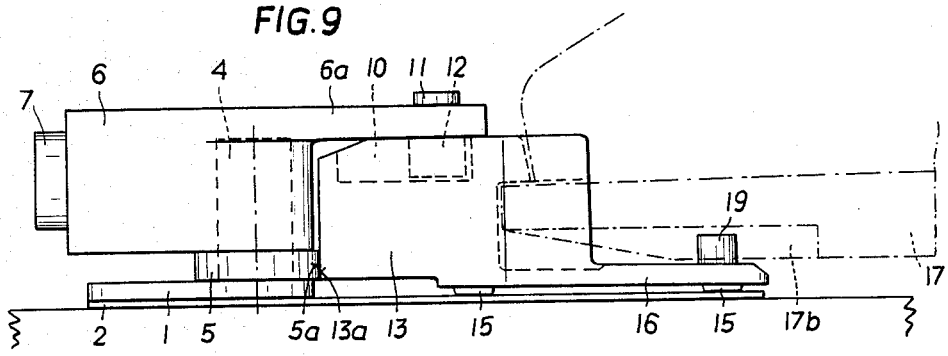
FIG. 9 shows a side view of the toe mechanism of FIG. 8.
Figure 8:
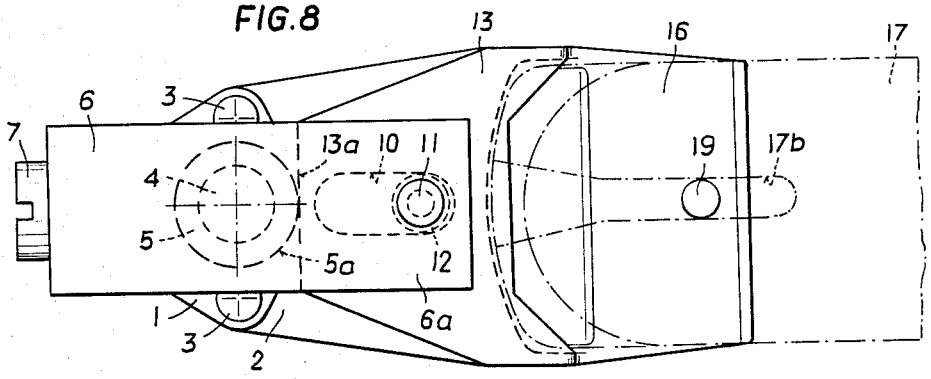
FIG. 8 shows a top plan view of a third embodiment of the toe mechanism.

The third embodiment of the toe mechanism as shown in FIGS. 8 and 9 differs from the previously described ones by the keying means between skid plate 16 and ski boot sole 17 being formed by a single cylindrical stop projection 19 on the upper surface of skid plate 16 and cooperating with a longitudinal groove 17*b* formed in the underside of ski boot sole 17. Groove 17*b* opens at the toe end of sole 17 with a flared or funnel-shaped enlarged portion facilitating entry of stop projection 19 during insertion of sole 17 into sole retainer 13. On rotation of the ski boot about an axis located at its heel portion, sole retainer 13 and stop projection 19 retained in groove 17*a* cooperate to couple ski boot sole 17 to skid plate 16 in such a manner that the latter is constrained to move in unison with the lateral twisting movement of the ski boot. Also in this case there occurs no relative rotation between skid plate 16 and ski boot sole 17 at least within the elastic yield limits as determined by the length of thrust surface 13*a*.

Figure 11:
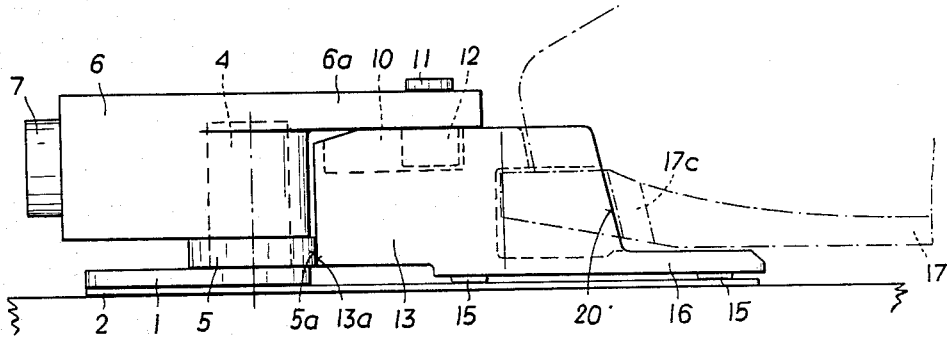
FIG. 11 shows a side view of the toe mechanism of FIG. 10.
Figure 10:
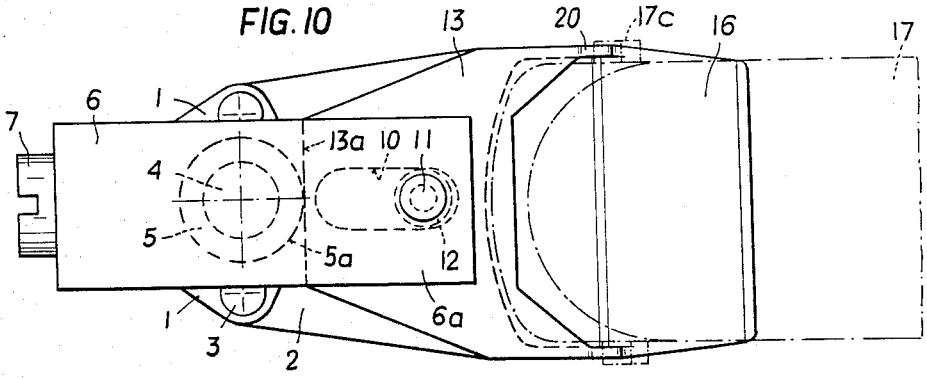
FIG. 10 shows a top plan view of a fourth embodiment of the toe mechanism.

The fourth embodiment of the toe mechanism as shown in FIGS. 10 and 11 differs from the previously described ones by the design of the keying means operatively connecting sole 17 to skid plate 16. In this embodiment, sole retainer 13 is formed with inclined lateral stop portions 20 adapted to be engaged by counter stop portions 17*c* projecting beyond the lateral contours of ski boot sole 17. Stop projections 17*c* advantageously extend over the full thickness of ski boot sole 17 and are formed with a forwardly facing stop edge extending accurately parallel to the stop portion of sole retainer 13. Under the action of the forward thrust exerted by the (not shown) heel mechanism, there is also in this case established a positive and force-transmitting connection between ski boot sole 17 and sole retainer 13, and thus with skid plate 16.

Figure 13:
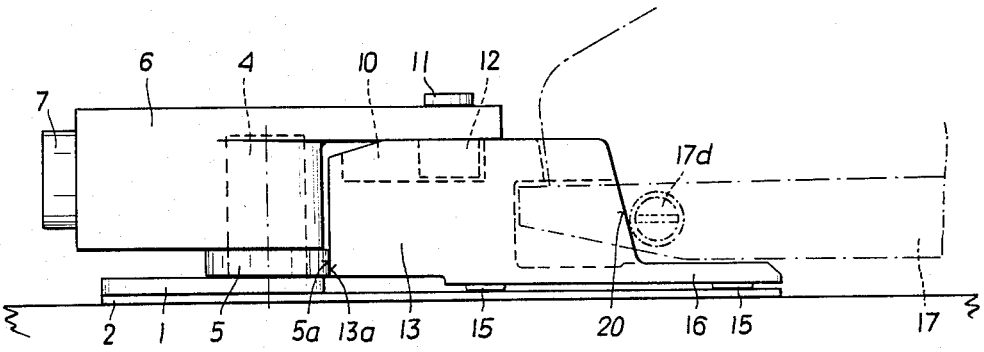
FIG. 13 shows a side view of the toe mechanism of FIG. 12.
Figure 12:
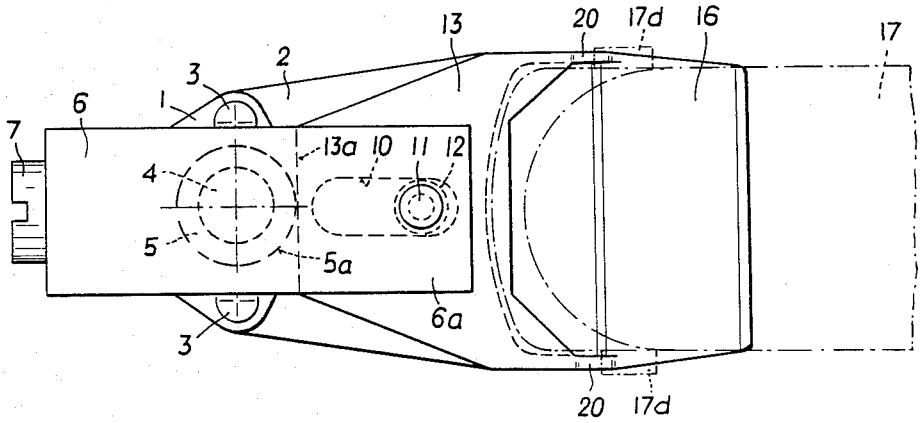
FIG. 12 shows a top plan view of a fifth embodiment of the toe mechanism.

A fifth embodiment of the toe mechanism as shown in FIGS. 12 and 13 differs from the previously described ones in that opposite lateral sides of ski boot sole 17 are provided with outwardly projecting stop projections 17*d*, such as cylindrical head screws adapted on insertion of ski boot sole 17 into sole retainer 13 to come into engagement with counter stop portions or surfaces 20 of sole retainer 13 to establish a two-sided operative connection between ski boot sole 17 and skid plate 16. it is also contemplated that stop projections 17*d* could be formed by a shaft extending transversely through ski boot sole 17 with laterally projecting ends.

In all of the above described embodiments of the toe mechanism, it is of particular importance that, even if portions of the keying means are incorporated in the ski boot sole, the ski boot can be used without restriction for normal walking, and may be employed with conventional toe mechanisms of any safety ski bindings, as the forward end portion of the ski boot, which in conventional toe mechanism is engaged by the sole retainer or clampdown portion, respectively, conforms to that of a standard sole.

A sixth embodiment shown in FIGS. 14, 15*a* and 15*b* differs from the previously described ones in that the lateral guiding jaws corresponding to the ones shown in FIGS. 1 to 5, designated 14*a* in this embodiment, are pivotably mounted on skid plate 16, enabling them on reaching the elastic yield limit (FIG. 15*b*) to be tilted out of the way, so as not to interfere with the release of the ski boot. To this effect, each lateral guide jaw 14*a* is mounted on skid plate 16 by means of a pivot axis 31 extending parallel to the longitudinal direction of skid plate 16 or at an angle thereto, as indicated by a dot-dash pivot axis 31', said angle corresponding to the pivot angle of skid plate 16 about the pivot axis at the rear portion of sole 17 within the elastic yield limits. The lateral guiding jaws 14*a* are prevented from being tilted out of the way within the elastic yield limits by the lateral edges 21*a* of ski 21 or by backup fittings 30 provided thereon. Only after passing backup fitting 30 or the upper ski edge 21*a* is the guiding jaw 14*a* facing towards the twisting direction able to be tilted out of the way, so that the ski boot is no longer prevented from being laterally released in the respective direction. The described arrangement for preventing the lateral guiding jaws from being tilted out of the way within the elastic yield limits may be replaced by other locking mechanisms located in skid plate 16, in sole retainer 13 or separate therefrom. In the tilted position, guiding jaws may extend in alignment with the upper surface of skid plate 16, or even therebelow, as indicated at 14*a*'. As soon as the release mechanism acts to return sole retainer 13 and skid plate 16 to the skiing position, the lateral guiding jaws are also cammed back to their upright operative position. Alternatively or additionally this function may be carried out by weak return springs.

In a seventh embodiment of a toe mechanism as shown in FIGS. 16 and 17, sole retainer 13 is again provided on both of its sides with lateral guiding jaws 14*b* connected thereto by pivot axes 31*a* extending perpendicular to the upper surface of the ski. A locking mechanism ensures that the lateral guiding jaws yield only after the toe mechanism has moved beyond its elastic yield limit. In the embodiment shown, each guiding jaw 14*b* is formed with an extension 32 extending into sole retainer 13 below the plane of the upper surface of skid plate 16, the pivotal movement of which is inhibited by a longitudinally slidable (at 36) stop member 33 in sole retainer 13 as long as the lateral movement of sole retainer 13 does not exceed the elastic yield limits. This is accomplished in a simple manner by connecting stop members 33 to a thrust bar 34 recessed into thrust surface 13*a* and adapted to project therefrom as soon as thrust surface 13*a* is disengaged from disk 5. Under the bias of a spring 35, thrust bar 34 will then project from thrust surface 13*a* so as to withdraw stop member 33 from extension 32, permitting guiding jaw 14*b* to pivot in the direction of arrow 37. Thrust bar 34 is advantageously formed with rounded ends to that on resetting of sole retainer 13 by the release mechanism, disk 5 pushes thrust bar 34 back into thrust surface 13*a*, whereby stop member 33 again projects into the path of extension 32. A (not shown) return spring in the pivot mounting of guiding jaw 14*b* ensures that guiding jaw 14*b* returns to its operative position immediately after the ski boot sole has left sole retainer 13.

Figure 18:
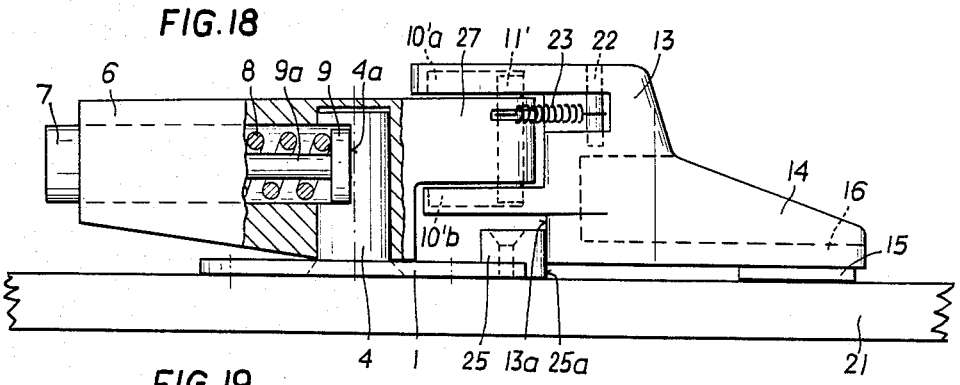
FIG. 18 shows a partially sectional side view of an eighth embodiment of the toe mechanism.
Figure 19:
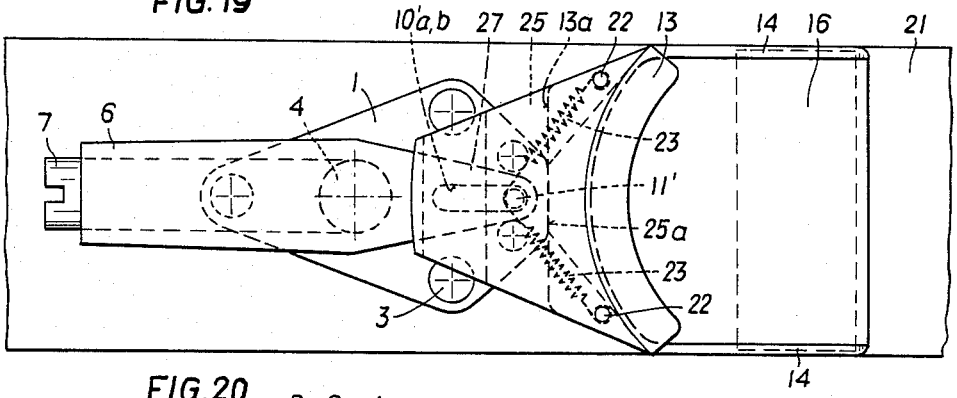
FIG. 19 shows a top plan view of the toe mechanism of FIG. 18 in its skiing position.

An eighth embodiment of a toe mechanism as shown in FIGS. 18 and 19 differs from the previously described ones mainly by the design of the hinged connection between sole retainer 13 and housing 6 of the release mechanism. Skid plate 16 is also in this case provided with lateral guiding jaws 14 for establishing a keyed connection between ski boot sole 17 and skid plate 16 by receiving the ski boot sole between them. In this embodiment, housing 6 has an extension 27 extending into sole retainer 13 and carrying a pin 11' both ends of which are received in longitudinally extending guide slots 10'*a*, 10'*b*. Affixed to base plate 1 between sole retainer 13 and housing 6 is a stop member 25 formed with a thrust surface 25*a* facing towards sole retainer 13. Opposite thereto the underside of sole retainer 13 is formed with a thrust surface 13*a* having a rectilinear center portion extending transversely of the longitudinal direction of the ski, and two rearwardly curved flanks. With the same length of thrust surface 13*a*, the elastic yield limits of this toe mechanism are wider than in the previously described embodiments, as the dimensions of the stationary thrust surface 25*a* transversely of the longitudinal direction of the ski are greater than those of disk 5 in the previous embodiments. On opposite sides of its longitudinal axis, sole retainer 13 carries two anchor pins 22 for anchoring one end of each of a pair of tension springs 23, the other ends of which are connected to pin 11'. Tension springs 23 serve for centering sole retainer 13 with respect to housing 6 of the release mechanism. This operative connection between sole retainer 13 and housing 6 ensures that after housing 6 and sole retainer 13 have been reset to the skiing position by the action of spring 8, sole retainer 13 remains in the skiing position even if there is no force-transmitting engagement between thrust surfaces 13*a* and 25*a*. As soon, however, as the ski boot is inserted into sole retainer 13, it exerts the customary forward thrust, whereby the thrust surfaces 13*a* and 25*a* are compressed into force-transmitting engagement to stabilize sole retainer 13.

Figure 20:
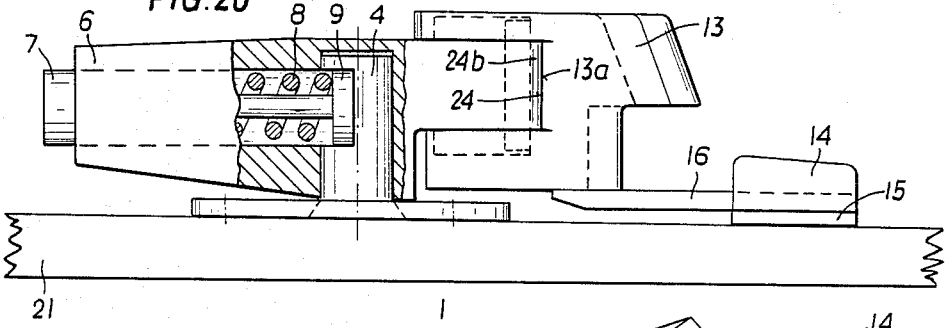
FIG. 20 shows a partially sectioned side view of a ninth embodiment of the toe mechanism.
Figure 21:
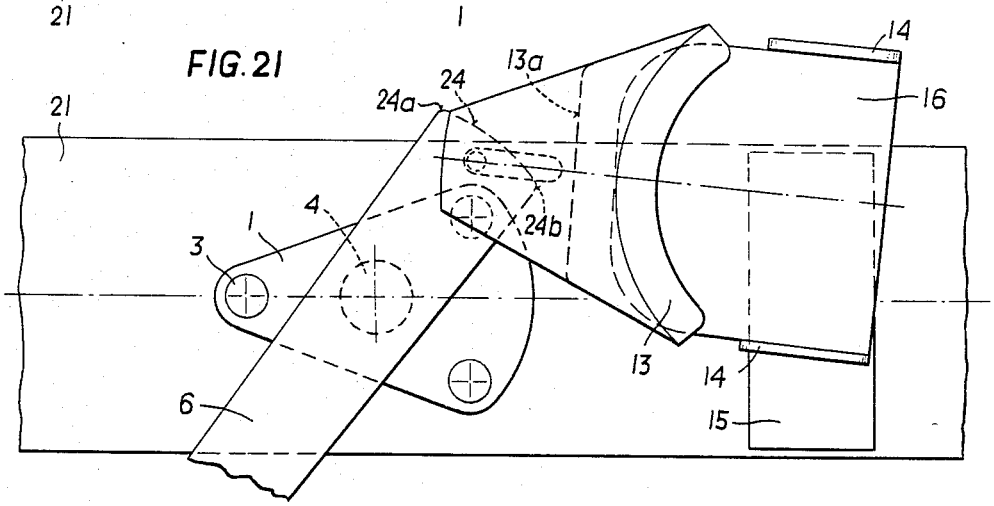
FIG. 21 shows a top plan view of the toe mechanism of FIG. 20 in its release position.

In a ninth embodiment according to FIGS. 20 and 21, skid plate 16 is formed with a pair of lateral guiding jaws 14 projecting upwards at some distance from sole retainer 13 so as to establish positive connection between the ski boot sole and skid plate 16 at the rear portion of the latter. In this embodiment, sole retainer 13 is stabilized not by means of stop member 25 fixedly connected to the ski as in FIGS. 18 and 19, nor by the employ of a disk fixedly connected to the ski as in FIGS. 1 to 17, but rather by cooperation of thrust surface 13*a* with a counter thrust surface 24 formed on housing 6 between lateral limits 24*a* and 24*b*. This type of stabilization necessarily results in the sole retainer being shifted towards the (not shown) heel mechanism on being reset to the skiing position, offering the additional advantage that within the elastic yield limits, the resetting action of the release mechanism located in housing 6 is enhanced by the forwardly biased sole retainer 13, so that the sole retainer together with the skid plate 16 reliably returns to the original position, taking the ski boots with it. In addition, this embodiment may also be provided with resilient means, such as the springs 23 shown in FIGS. 18 and 19, for assisting the centering of sole retainer 13.

The embodiments of the invention in which an exclusive property or privilege is claimed are defined as follows:

1. A toe holding mechanism for a safety ski binding adapted to releasably hold a ski boot on a ski, comprising: a toe holder engageable with a front end of a sole of said ski boot; a support plate provided on said toe holder and extending under and supporting the sole of said ski boot when said front end thereof is engaging said toe holder, said support plate extending rearwardly below the sole of said ski boot a maximum distance of approximately half the length of the sole of said ski boot and being free of operative connection to the ski at a rear end thereof; means supporting said toe holder and support plate for pivotal movement about a generally vertical axis and for movement generally transversely of the ski; resilient means for yieldably resisting transverse movement of said toe holder and support plate in either direction away from an initial position; means supporting said toe holder and support plate for movement generally longitudinally of the ski after they have moved transversely a predetermined distance away from said initial position; and keying means cooperable with the sole of said ski boot and at least one of said toe holder and support plate for preventing pivotal movement about a further vertical axis of the sole of said ski boot relative to said toe holder and support plate during transverse movement of said toe holder and support plate until said toe holder and support plate have moved at least said predetermined distance from said initial position thereof; wherein said means supporting said toe holder and support plate for pivotal and transverse movement includes a release member supported for pivotal movement about a generally vertical pivot axis, said resilient means yieldably resisting pivotal movement of said release member away from a position in which said toe holder is in said initial position, a generally vertical pin provided on said release member at a location spaced radially from said pivot axis thereof in a direction toward the rear end of the ski, and a recess which is provided in said toe holder and rotatably receives said pin; wherein said means supporting said toe holder and support plate for movement generally longitudinally of the ski includes said recess in said toe holder being a slot which slidably receives said pin and extends generally longitudinally of the ski when said toe holder is in said initial position; and including means for preventing longitudinal movement of said toe holder and support plate toward the tip of the ski relative to said release member until said toe holder and support plate have moved transversely at least said predetermined distance from said initial position.

2. The toe holding mechanism according to claim 1, wherein said keying means includes two substantially parallel guide members provided on opposite sides of and projecting upwardly from said support plate, the sole of said ski boot being received therebetween when it is engaging said toe holder.

3. The toe holding mechanism according to claim 1, wherein said keying means includes at least one stop member provided on an upper surface of said support plate and engageable with a recess provided in an underside of the sole of said ski boot.

4. The toe holding mechanism according to claim 1, wherein said keying means includes stop surfaces provided on one of said support plate and said toe holder, and fittings which are provided on the sole of said ski boot and are adapted to engage said stop surfaces.

5. The toe holding mechanism according to claim 1, wherein said keying means includes stop surfaces provided on one of said toe holder and said support plate and keying members provided on opposite lateral sides of the sole of said ski boot and adapted to engage said stop surfaces.

6. The toe holding mechanism according to claim 1, wherein said keying means includes the sole of said ski boot being shaped so as to facilitate use of said ski boot with a conventional toe holding mechanism without significantly interfering with proper and safe operation thereof.

7. The toe holding mechanism according to claim 1, wherein said keying means is adapted to facilitate disengagement of the sole of said ski boot from said toe holder and said support plate after said toe holder and support plate have moved more than said predetermined distance from said initial position, thereby permitting said front end of said ski boot sole to freely move transversely relative to the ski.

8. The toe holding mechanism according to claim 7, wherein said keying means includes two guide members which are provided on opposite sides of one of said toe holder and said support plate and are supported for pivotal movement about respective axes which each extend in a direction which is one of parallel to and perpendicular to an upper surface of said support plate.

9. The toe holding mechanism according to claim 8, wherein each said guide member is supported on a respective axle which is coincident with a respective said guide member pivot axis, and wherein said axles are each supported on one of said support plate and said toe holder.

10. The toe holding mechanism according to claim 8, wherein said guide member pivot axes each extend substantially parallel to a longitudinal axis of said support plate.

11. The toe holding mechanism according to claim 8, wherein said guide member pivot axes are each arranged at an angle with respect to a longitudinal axis of said support plate, said angle being substantially equal to an angle between said longitudinal axis of said support plate and a longitudinal axis of the ski when said toe holder and support plate have moved said predetermined distance from said initial position, one of said guide member pivot axes being substantially parallel to a lateral edge of the ski when said toe holder and support plate have moved said predetermined distance from said initial position.

12. The toe holding mechanism according to claim 8, wherein said guide member pivot axes extend perpendicular to a transverse axis of the ski, and wherein said keying means is adapted to cause at least one of said guide members to tilt away from the sole of said ski boot after said toe holder and support plate have moved said predetermined distance from said initial position.

13. The toe holding mechanism according to claim 8, wherein said keying means includes pivot lock means cooperable with said guide members for preventing pivotal movement thereof away from the sole of said ski boot until said toe holder and support plate have moved said predetermined distance from said initial position.

14. The toe holding mechanism according to claim 8, wherein said keying means includes means defining on an upper surface of the ski a support bearing adjacent each of the lateral edges of the ski, each said support bearing being cooperable with a respective said guide member so as to prevent tilting of such guide member away from the sole of said ski boot until said toe holder and support plate have moved said predetermined distance from said initial position.

15. The toe holding mechanism according to claim 1, wherein said keying means includes two recesses provided in an undersurface of the sole of said ski boot adjacent opposite lateral edges thereof and extending from said front end of the sole of said ski boot to a location spaced rearwardly of said front end, and wherein said keying means includes two laterally spaced projections on said support plate which are each received in a respective said recess at the rearmost end thereof when said ski boot is engaging said toe holder.

16. The toe holding mechanism according to claim 1, wherein said keying means includes a slotlike recess provided in the undersurface of the sole of said ski boot and extending rearwardly from said front end thereof, and includes an upward projection provided on an upper surface of said support plate and slidably received in said recess when the sole of said ski boot is engaging said toe holder.

17. The toe holding mechanism according to claim 1, wherein said keying means includes said toe holder having means defining a rearwardly facing, upwardly and forwardly inclined stop surface on each side of the sole of said ski boot, and includes said ski boot having an integral lateral projection on each side thereof, each said lateral projection having thereon a forwardly facing, upwardly and forwardly inclined stop surface which engages a respective one of said stop surfaces on said toe holder when the sole of said ski boot is operatively engaging said toe holder.

18. The toe holding mechanism according to claim 1, wherein said keying means includes said toe holder having means defining two spaced, rearwardly facing stop surfaces located on opposite sides of the sole of said ski boot, and includes said ski boot having a cylindrical head screw on each side of and screwed into the sole thereof, the cylindrical head of each said screw projecting laterally outwardly from the sole of said ski boot and engaging a respective said stop surface on said toe holder when the sole of said ski boot is operatively engaged with said toe holder.

* * * * *